US006908153B2

(12) United States Patent
Blendea

(10) Patent No.: US 6,908,153 B2
(45) Date of Patent: Jun. 21, 2005

(54) POWER LUMBAR SUPPORT CABLE APPARATUS AND METHOD

(75) Inventor: Horia Blendea, Windsor (CA)

(73) Assignee: L&P Property Management Company, South Gate, CA (US)

( * ) Notice: Subject to any disclaimer, the term of this patent is extended or adjusted under 35 U.S.C. 154(b) by 3 days.

(21) Appl. No.: 10/307,627

(22) Filed: Dec. 2, 2002

(65) Prior Publication Data

US 2004/0104609 A1 Jun. 3, 2004

(51) Int. Cl.[7] ..... A47C 3/025

(52) U.S. Cl. ..... 297/284.4; 297/284.7; 297/452.3

(58) Field of Search ..... 297/284.1, 284.4, 297/284.7, 284.8, 452.3

(56) References Cited

U.S. PATENT DOCUMENTS

| | | | | |
|---|---|---|---|---|
| 1,182,854 | A | 5/1916 | Poler | |
| 2,756,809 | A | 7/1956 | Endresen | 155/182 |
| 2,843,195 | A | 7/1958 | Barvaeus | 155/182 |
| 2,942,651 | A | 6/1960 | Binding | 155/131 |
| 3,378,299 | A | 4/1968 | Sandor | 297/284 |
| 3,490,084 | A | 1/1970 | Schuster | 5/351 |
| 3,492,768 | A | 2/1970 | Schuster | 52/98 |
| 3,724,144 | A | 4/1973 | Schuster | 52/108 |
| 3,762,769 | A | 10/1973 | Poschl | 297/284 |
| 4,136,577 | A | 1/1979 | Borgersen | 74/479 |
| 4,153,293 | A | 5/1979 | Sheldon | 297/284 |
| 4,156,544 | A | 5/1979 | Swenson et al. | 297/284 |
| 4,182,533 | A | 1/1980 | Arndt et al. | 297/284 |
| 4,295,681 | A | 10/1981 | Gregory | 297/284 |
| 4,313,637 | A | 2/1982 | Barley | 297/284 |
| 4,316,631 | A | 2/1982 | Lenz et al. | 297/284 |
| 4,354,709 | A | 10/1982 | Schuster | 297/284 |
| 4,390,210 | A | 6/1983 | Wisniewski et al. | 297/452 |
| 4,449,751 | A | 5/1984 | Murphy et al. | 297/284 |
| 4,452,485 | A | 6/1984 | Schuster | 297/284 |

(Continued)

FOREIGN PATENT DOCUMENTS

| | | | |
|---|---|---|---|
| AT | 401 497 | 9/1996 | B60N/2/22 |
| DE | 2040794 | 7/1971 | A47C/7/28 |
| DE | 206 4419 | 7/1972 | B60N/1/06 |
| DE | 29 47 472 | 8/1980 | B60N/1/00 |
| EP | 0 006 840 B1 | 2/1982 | A47C/23/00 |
| EP | 0 322 535 A1 | 7/1989 | A47C/7/46 |
| EP | 0 485 483 B1 | 1/1994 | A47C/7/46 |
| EP | 0 434 660 B1 | 5/1995 | A47C/7/46 |
| EP | 0 540 481 B1 | 12/1995 | A47C/7/46 |
| EP | 0 662 795 B1 | 12/1996 | A47C/7/46 |
| EP | 0 702 522 B1 | 3/1997 | A47C/7/46 |
| EP | 0 696 251 B1 | 7/1997 | B60N/2/44 |
| EP | 0 169 293 B1 | 10/1998 | A47C/7/46 |
| EP | 0 746 219 B1 | 11/1998 | A47C/7/46 |
| EP | 0 797 399 B1 | 11/1998 | A47C/7/46 |
| EP | 0 698 360 B1 | 3/2000 | A47C/7/46 |
| FR | 2 596 334 | 10/1987 | B60N/1/06 |
| GB | 1 423 617 | 2/1976 | A47C/7/46 |
| GB | 2 013 487 | 2/1978 | A47C/7/46 |
| RU | 587924 | 2/1978 | A47C/7/46 |
| WO | WO 94/25307 | * 11/1994 | B60N/2/44 |
| WO | WO/00/00064 | 1/2000 | A47C/3/025 |

*Primary Examiner*—Peter M. Cuomo
*Assistant Examiner*—Stephen Vu
(74) *Attorney, Agent, or Firm*—Husch & Eppenberger, LLC; Grant D. Kang

(57) ABSTRACT

A lumbar support system includes a fixed mounting bracket having a first traction cable sleeve support, a second sleeve support and a slider guide. A traction cable having a wire disposed to slide axially through a first sleeve and second sleeve, is attached to the first sleeve support of the fixed mounting bracket and to an actuator operatively engaged with the traction cable wire. A slider is also attached to the traction cable wire, is operatively engaged with the slider guide and adjusts the position of a flexible support element as it slides along the slider guide.

10 Claims, 6 Drawing Sheets

U.S. PATENT DOCUMENTS 4,564,235 A 1/1986 Hatsutta et al. ..... 297/284
4,565,406 A 1/1986 Suzuki ..... 297/284
4,576,410 A 3/1986 Hattori ..... 297/284
4,601,514 A 7/1986 Meiller ..... 297/284
4,602,819 A 7/1986 Morel ..... 297/460
4,627,661 A 12/1986 Ronnhult et al. ..... 297/284
4,630,865 A 12/1986 Ahs ..... 297/284
4,632,454 A 12/1986 Naert ..... 297/284
4,676,550 A 6/1987 Neve De Mevergnies .. 297/353
4,679,848 A 7/1987 Spierings ..... 297/284
4,730,871 A 3/1988 Sheldon ..... 297/230
4,880,271 A 11/1989 Graves ..... 257/284
4,909,568 A 3/1990 Dal Monte ..... 292/284
4,915,448 A 4/1990 Morgenstern ..... 297/284
4,950,032 A 8/1990 Nagasaka ..... 297/284
4,957,102 A 9/1990 Tan et al. ..... 128/68
4,968,093 A 11/1990 Dal Monte ..... 297/284
5,005,904 A 4/1991 Clemens et al. ..... 297/284
5,022,709 A 6/1991 Marchino ..... 297/452
5,026,116 A 6/1991 Dal Monte ..... 297/284
5,050,930 A 9/1991 Schuster et al. ..... 257/284
5,076,643 A 12/1991 Colasanti et al. ..... 297/284
5,088,790 A 2/1992 Wainwright et al. ..... 297/284
5,137,329 A 8/1992 Neale ..... 297/284
5,174,526 A 12/1992 Kanigowski ..... 244/122
5,197,780 A 3/1993 Coughlin ..... 297/284.7
5,215,350 A 6/1993 Kato ..... 297/284.4
5,217,278 A 6/1993 Harrison et al. ..... 297/284.7
5,286,087 A 2/1994 Elton ..... 297/284.7
5,299,851 A 4/1994 Lin ..... 297/284.5
5,335,965 A 8/1994 Sessini ..... 297/284.4
5,385,531 A 1/1995 Jover ..... 601/99
5,397,164 A 3/1995 Schuster ..... 297/284.1
5,423,593 A 6/1995 Nagashima ..... 297/284.5
5,449,219 A 9/1995 Hay et al. ..... 297/284.4
5,452,868 A 9/1995 Kanigowski ..... 244/122 R
5,474,358 A 12/1995 Maeyaert ..... 297/284.7
5,498,063 A 3/1996 Schuster et al. ..... 297/284.1
5,518,294 A 5/1996 Ligon, Sr. et al. ..... 297/284.4
5,553,917 A 9/1996 Adat et al. ..... 297/230.14
5,562,324 A 10/1996 Massara et al. ..... 297/284.6
5,567,010 A 10/1996 Sparks ..... 297/284.4
5,567,011 A 10/1996 Sessini ..... 297/284.4
4,465,317 A 8/1984 Schwarz ..... 297/284
4,541,670 A 9/1985 Morgenstern et al. ..... 297/284
4,555,140 A 11/1985 Nemoto ..... 297/452
4,556,251 A 12/1985 Takagi ..... 297/284
5,588,703 A 12/1996 Itou ..... 297/284.4
5,609,394 A 3/1997 Ligon, Sr. et al. ..... 297/284.4
5,626,390 A 5/1997 Schuster et al. ..... 297/284.1
5,638,722 A 6/1997 Klingler ..... 74/502.4
5,651,583 A 7/1997 Klingler et al. ..... 297/284.4
5,651,584 A 7/1997 Chenot et al. ..... 297/284.4
5,704,687 A 1/1998 Klingler ..... 297/284.4
5,718,476 A 2/1998 De Pascal et al. ..... 297/284.4
5,758,925 A 6/1998 Schrewe et al. ..... 297/284.6
5,762,397 A 6/1998 Venuto et al. ..... 297/284.4
5,769,491 A 6/1998 Schwarzbich ..... 297/284.4
5,772,281 A 6/1998 Massara ..... 297/284.4
5,775,773 A 7/1998 Schuster et al. ..... 297/284.1
5,791,733 A 8/1998 Van Hekken et al. .... 297/284.4
5,816,653 A 10/1998 Benson ..... 297/284.4
5,823,620 A 10/1998 Le Caz ..... 297/284.4
5,857,743 A 1/1999 Ligon, Sr. et al. ..... 297/284.9
5,868,466 A 2/1999 Massara et al. ..... 297/284.6
5,884,968 A 3/1999 Massara ..... 297/216.12
5,897,168 A 4/1999 Bartelt et al. ..... 297/452.18
5,911,477 A 6/1999 Mundell et al. ..... 297/284.4
5,913,569 A 6/1999 Klingler ..... 297/284.4
5,934,752 A 8/1999 Klingler ..... 297/284.4
5,975,632 A 11/1999 Ginat ..... 297/284.4
5,984,407 A 11/1999 Ligon, Sr. et al. ..... 297/284.4
5,988,745 A 11/1999 Deceuninck ..... 297/284.4
6,003,941 A 12/1999 Schuster, Sr. et al. ... 297/284.1
6,007,151 A 12/1999 Benson ..... 297/284.4
6,030,041 A 2/2000 Hsiao ..... 297/284.4
6,036,265 A 3/2000 Cosentino ..... 297/284.4
6,045,185 A 4/2000 Ligon, Sr. et al. ..... 297/284.4
6,050,641 A 4/2000 Benson ..... 297/284.4
6,079,783 A 6/2000 Schuster, Sr. et al. ... 297/284.4
6,092,871 A 7/2000 Beaulieu ..... 297/284.4
6,152,531 A 11/2000 Deceuninck ..... 297/284.4
6,152,532 A 11/2000 Cosentino ..... 297/284.4
6,158,300 A 12/2000 Klingler ..... 74/526
6,227,617 B1 5/2001 Von Möller ..... 297/284.4
6,227,618 B1 5/2001 Ligon, Sr. et al. ..... 297/284.4
6,254,186 B1 7/2001 Falzon ..... 297/284
6,254,187 B1 7/2001 Schuster, Sr. et al. ... 297/284.1
6,270,158 B1 8/2001 Hong ..... 297/284.4
6,296,308 B1 10/2001 Cosentino et al. ..... 297/284.4
6,334,651 B1 1/2002 Duan et al. ..... 297/284.4
6,345,549 B1 2/2002 Lance ..... 74/500.5
6,357,826 B1 * 3/2002 Gabas et al. ..... 297/284.4
6,375,262 B1 * 4/2002 Watanabe ..... 297/284.4
6,447,061 B1 * 9/2002 Klingler ..... 297/284.4
2002/0113471 A1 8/2002 Blendea et al. ..... 297/284.4

* cited by examiner

POWER LUMBAR SUPPORT CABLE APPARATUS AND METHOD

CROSS-REFERENCE TO RELATED APPLICATIONS

None.

STATEMENT REGARDING FEDERALLY SPONSORED RESEARCH OR DEVELOPMENT

Not Applicable.

FIELD OF THE INVENTION

This invention relates generally to an apparatus for reducing muscle fatigue and discomfort of a seated occupant and, more particularly, to an adjustable ergonomic support structure in a seat. The support structure in a seat may be adjusted to relieve muscle fatigue and discomfort.

BACKGROUND OF THE INVENTION

Individuals who remain seated for an extended period of time may develop symptoms of muscle fatigue and blood circulation problems. It is known that such muscle fatigue and circulation problems may be relieved, in part, by a lumbar support whose position is adjustable along a guide track.

Conventional adjustable lumbar support systems typically employ a mechanical adjusting means or a motor and gearbox assembly, commonly referred to as actuators, as an adjusting means. A four-way power lumbar support system may provide a level adjustment in a vertical direction and an arching adjustment of a flexible, resilient support element in a horizontal direction toward and away from a seat occupant. Such a system requires two separate actuators, that is, one for each adjustment direction.

Conventional variable lumbar support devices have generally included two traction cables for applying the force of the actuators to the lumbar support. Bowden cables are commonly used as traction cables for such devices. Lumbar supports employing Bowden type or other traction cable assemblies as part of a means for adjusting the lumbar support in a seat are known. Bowden or traction cables are coaxial mechanical devices wherein a wire slides axially through a sleeve or conduit. Traction cables have been found to be an efficient means for applying traction to moving parts of a lumbar support.

It is known to anchor a traction cable sleeve end to one part of the lumbar support device and to anchor the traction cable wire end to another part of the movable lumbar support device. When so anchored, drawing the traction cable wire through the traction cable sleeve causes the moving parts of the lumbar support device to travel from a relaxed, substantially flat and non-supporting position to a tensioned, supporting position such as a bowed arch. In the more expensive lumbar support systems, traction is applied via an electric motor, which acts on the end of the traction cable opposite the lumbar support device to draw the wire of a traction cable through the sleeve of the traction cable. For devices to be installed in more economical seats, mechanical actuators are used.

Prior art devices are known which provide lumbar supports that are slidable along a guide track. The support elements may be rigid or flexible. In some of these prior art devices, a traction cable is used to apply force to the support member for adjustment of the support member in one direction. Such an arrangement in conventional lumbar support systems has typically required the use of a spring to counteract the force of the traction cable, to bias the support member towards a rest position and to apply force to the support member in the return direction. Use of a spring to counteract the force of the traction cable is disadvantageous because overcoming the spring requires higher operating forces for the lumbar support system.

Such devices include several other drawbacks and limitations as well. Many of the commonly used adjustable lumbar support devices are composed of a relatively large number of parts. This is problematic because it renders these types of devices difficult to manufacture, package and assemble. Weight and expense are increased. Furthermore, these relatively complex conventional lumbar support devices are expensive to manufacture and may be unreliable and prone to breakdown. More powerful motors are required to overcome the forces of the springs, further increasing weight and expense. In mechanically actuated devices, complicated linkages become necessary to overcome the spring force.

Highly competitive markets for automobile seats and furniture place a premium on optimization of weight, cost and durability. There is a need in the industry for reducing the complication of assemblies, reducing packaging size, reducing cost and increasing durability. Accordingly, the need exists to provide an improved power lumbar support system that is cost-effective and light weight, yet still provides the quality of performance equal to that of conventional lumbar support systems.

SUMMARY OF THE INVENTION

The present invention provides such a power lumbar support system having improved packaging dimensions and lighter weight, while providing the comfort and lumbar support of conventional power lumbar support systems. The present invention's use of a novel cable assembly for the height adjustment of the lumbar support system reduces overall weight and expense. This novel cable assembly eliminates the need for certain spring and pulley elements and additional brackets for them that are used in conventional cable assemblies. Use of this cable assembly may also allow for the use of smaller diameter cables and a less expensive, lower power actuator.

A closed loop cable assembly or a two-cable assembly may be used in order to achieve these objectives. One traction cable end pulls the lumbar supporting element in a first direction, and another traction cable end, instead of a spring, pulls the support element in the opposite direction. The directions are usually vertical.

An additional cable actuates in and out motion.

The present invention is an ergonomic support device intended for use in automobile seats and furniture. This device includes a fixed mounting bracket having a first sleeve support, a second sleeve support and a slider guide; a traction cable having a wire disposed to slide axially through a first sleeve and second sleeve, with the first sleeve having a first sleeve end attached to the first sleeve support and a second sleeve end attached to an actuator operatively engaged with the wire, and the second sleeve having a first sleeve end attached to the second sleeve support and a second sleeve end attached to the actuator. The device further includes a slider that is attached to the wire. The slider is operatively engaged to the slider guide and adjusts an axial position of a flexible support element as it slides along the slider guide.

The present invention is an improvement over conventional power lumbar support systems in that it provides a system that is light weight, compact and requires fewer components. Additional features and advantages of the present invention, as well as the structure and operation of various preferred embodiments of the present invention, are described in detail below, with reference to the accompanying drawings.

DETAILED DESCRIPTION

Figure 1:
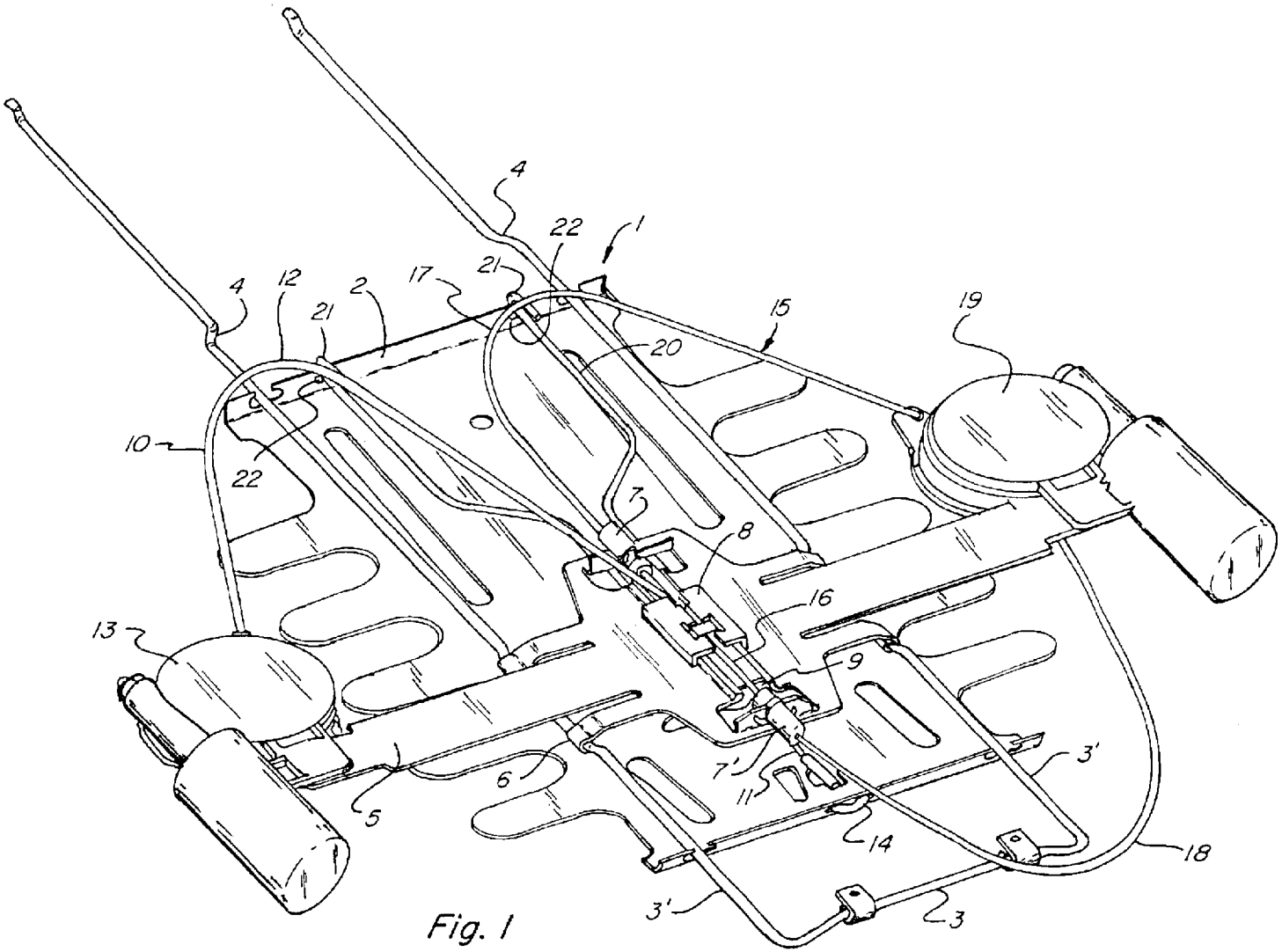
FIG. 1 illustrates a perspective view of the lumbar support system of the present invention.

Referring now to the drawings, there is depicted a lumbar support device 1 embodying the concepts of the present invention. The lumbar support device 1 of the present invention is generally identified in the drawings. In the preferred embodiment, the lumbar support device 1 may be used for providing lumbar support in the seat of an automobile. However, the present invention is not limited to use in automobile seats and may be used in any type of seat.

FIG. 1 shows a flexible support element 2 slidably connected to a guide wire 3. The support element is sometimes known as a "basket" by those of skill in the art. The support element 2 is capable of adjustment in an in/out direction and an up/down direction relative to and along the guide wire 3. The support element 2 may be made of any general material including plastic, metal or any combination thereof and is naturally biased towards a substantially flat shape.

Figure 3:
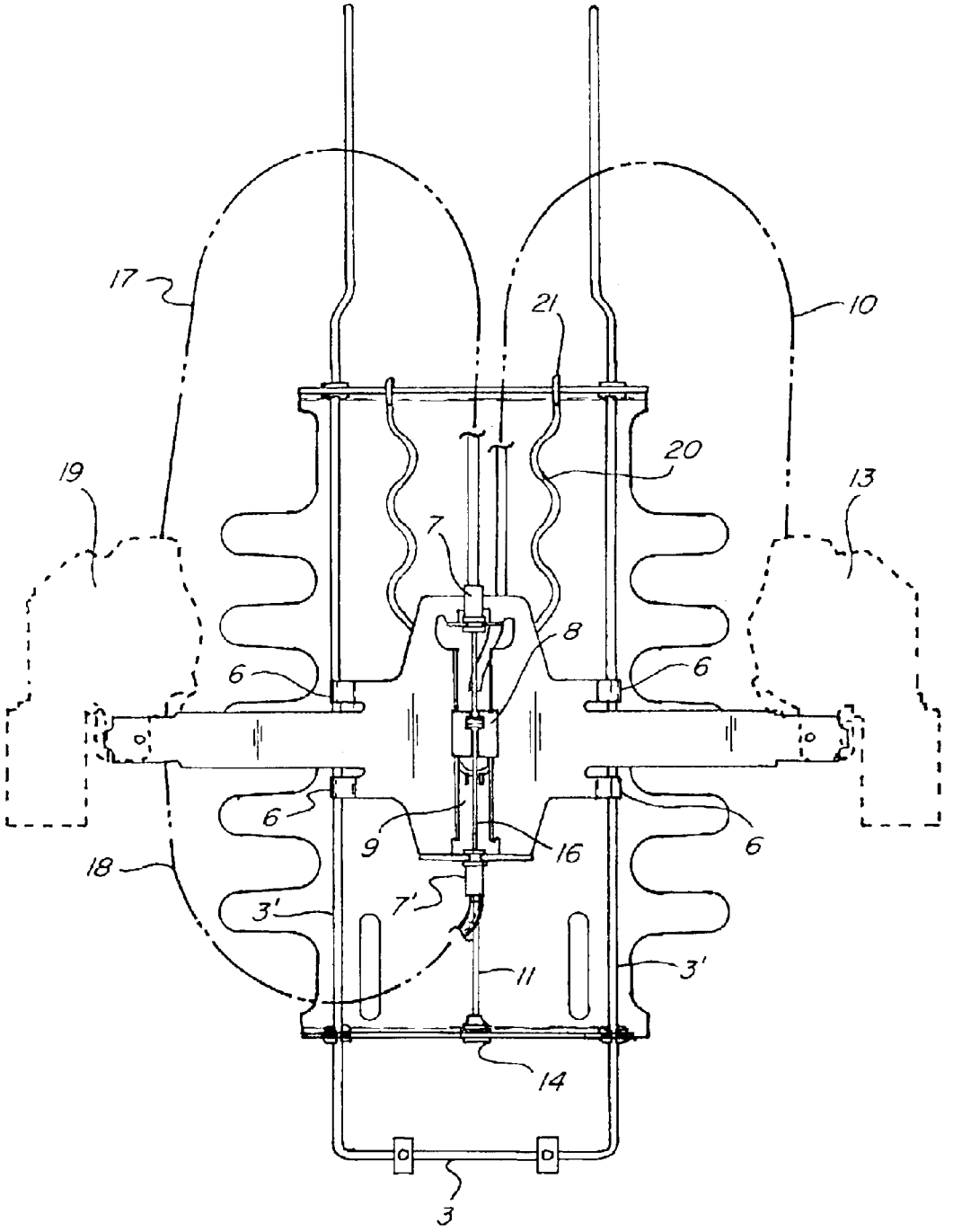
FIG. 3 illustrates a front view of the lumbar support system of the present invention, without the basket attached.

The substantially parallel guide wire members 3', 3' have end stops 4 which prevent the support element 2 from sliding beyond the end stops 4. In the embodiment depicted in FIG. 1, the guide wire 3 is comprised of a single wire member fabricated in a substantially U-shaped manner to provide two substantially parallel guide wire members 3', 3' that guide the support element 2 as it is adjusted in an up/down direction. The guide wire 3 is adaptable to mount the entire assembly in a seat frame (not shown). A mounting bracket 5 is connected to each of the guide wire members 3', 3' at a position between the opposite end stops 4 of the parallel guide wire members 3', 3'. Any type of attachment device may be used to secure the mounting bracket 5 to the guide wire members 3', 3'. For example, as shown in FIG. 3, the mounting bracket 5 may be attached to the parallel guide wire members 3', 3' via a plurality of anti-friction sleeve basket slots 6. The mounting bracket 5 also includes a plurality of sleeve supports 7, 7' for receiving and securing traction cable sleeves.

Figure 5:
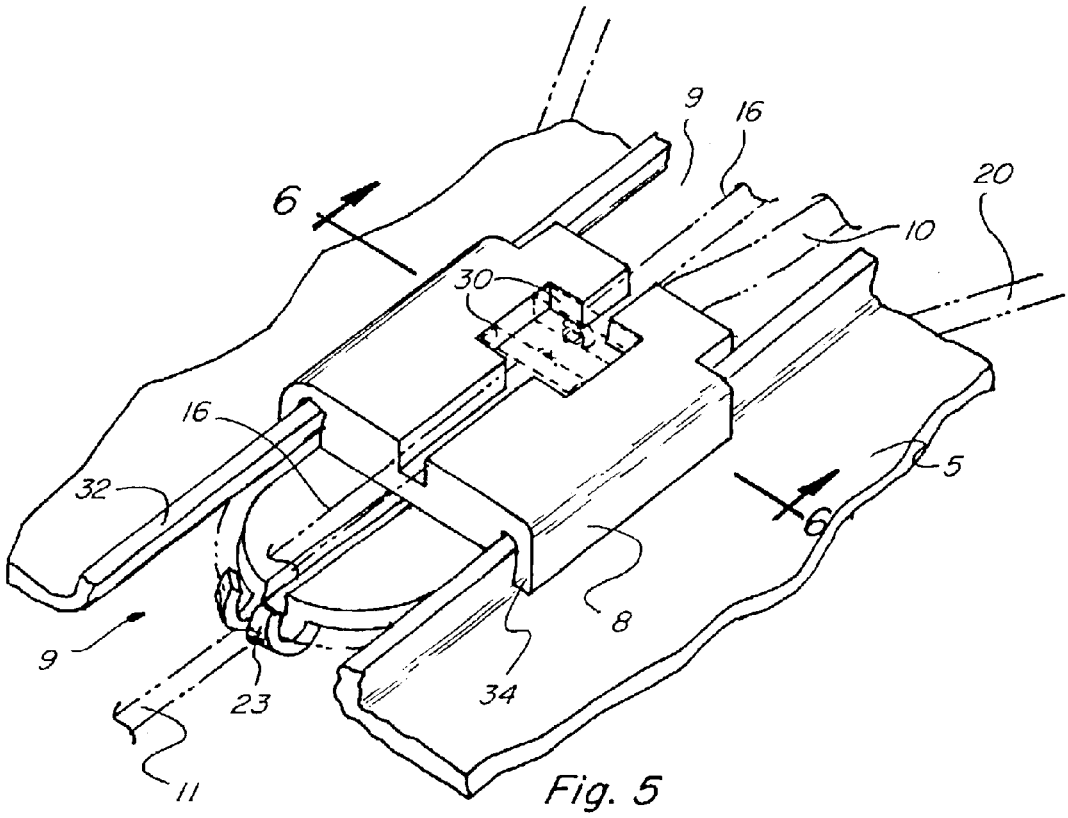
FIG. 5 illustrates a perspective view of the slider of the present invention.

A slider 8 is slidably arranged on the mounting bracket 5. The means by which the slider 8 is arranged on the mounting bracket 5 may vary. By way of example, FIG. 5 shows the slider engaged in a slider guide slot 9 of the mounting bracket 5, which allows for the sliding of the slider 8 along the slider guide slot 9 mounting bracket 5. The slider guide may comprise a number of different structures designed to engage the slider 8 as it slides along the slider guide 9, such as the slot shown in FIG. 5, or alternatively, a guide rail (not shown).

The depicted flexible support element 2 is capable of adjustment in a horizontal direction toward and away from a seat occupant. This adjusting in a horizontal direction is accomplished by virtue of a traction cable arrangement. The traction cable arrangement includes a first traction cable 10 comprised of a first wire 11 in a first sleeve 12, wherein the first cable is attached to a first actuator 13. The first actuator 13 may be any actuator used in conventional mechanical lumbar support systems for the purpose of providing arching directional adjustment of a flexible support element. The first wire 11 of the traction cable arrangement extends from the first sleeve 12 and is fixed at one end to the first actuator 13 and fixed at its other end to the support element 2. The first wire 11 may be attached to the support element 2 in a number of different ways known in the art, including by way of a hook 14, as shown in FIG. 1. Traction drawing the first wire 11 into the first sleeve 12 will draw the bottom of support element 2 upwards, shortening the distance between the top and bottom ends of the support element 2. This causes the support element 2 to bow outwards and create an arch to support the seat occupants' lumbar spine. Reversing the first actuator 13 to extend the first wire 11 out of the first sleeve 12 will lengthen the distance between the top and bottom ends of the support element 2 and, along with the natural force that is created by the support element 2 as it returns to its natural, relaxed shape, will cause the support element 2 to move toward an unsupporting, substantially flat shape.

The first actuator 13 engages the first wire 11 in order to put traction on the first wire 11. The rotating action of the first actuator 13 may be accomplished by a variety of means, including hand wheels or levers. The first actuator 13 may also be driven via an electric motor. The first actuator 13 may be mounted on the seat frame (not shown) or may advantageously be mounted to the bracket 5, as shown in a preferred embodiment, seen in FIG. 1. Attaching the first actuator 13 to the bracket 5 is advantageous for ease of packaging, shipping and installation of the lumbar support device 1.

In the embodiment shown in FIG. 1, there is provided a second traction cable 15 that is a closed loop single cable (depicted) or, alternatively two separate, substantially opposing cables. The second traction cable 15 is comprised of a second wire 16 in an upper sleeve 17 and a lower sleeve 18. The upper sleeve 17 is fixed at one end to a sleeve support 7 of the mounting bracket 5, as shown in FIG. 1, and is fixed at its other end to a second actuator 19. The sleeve support 7 is positioned to align sleeve 17 and wire 16 with the slider 8 and slider guide slot 9. The lower sleeve 18 is fixed to sleeve support 7' at the bottom end of the slider guide slot 9 and is fixed at its other end to the second actuator 19. Like the first actuator 13, the second actuator 19 may be mounted on the seat (not shown) or may advantageously be mounted to the bracket 5, as shown in FIG. 1. The end of the upper sleeve 17 and the end of the lower sleeve 18 may be fixed to the mounting bracket 5 a number of different ways, such as via sleeve supports 7, 7', as shown in FIG. 1. The second wire 16 is operably engaged with the second actuator 19 and is attached to the slider 8.

Actuators known in the art, such as the depicted actuator 19, may engage a central portion of a single wire such as wire 16 progressing through opposing Bowden cable sleeves such as the depicted sleeves 17 and 18. In such a case, as in the depicted embodiment, the two ends of wire 16 are both attached to slider 8. Alternatively, two separate traction cables with two separate sleeves and two separate wires may be attached to two separate actuators. In this case each cable would have a sleeve and a wire end attached to one actuator and an opposite end of each cable would have the opposite sleeve end attached to sleeve support 7 or 7' and the opposite end of the wire would proceed from the sleeve end to be attached to the slider 8. Hence slider 8 would be drawn in a first direction, for example upwards, by traction applied to it through one Bowden cable wire and the slider 8 would be drawn in a second direction, for example downwards, by traction on it by a second Bowden cable wire end. Accordingly, whether the slider 8 is acted upon by the two ends of a single wire, as depicted wire 16, or whether it is acted upon by two separate wires, traction in a first direction will draw the slider upwards and the traction in the second direction would draw the slider downwards.

Figure 2:
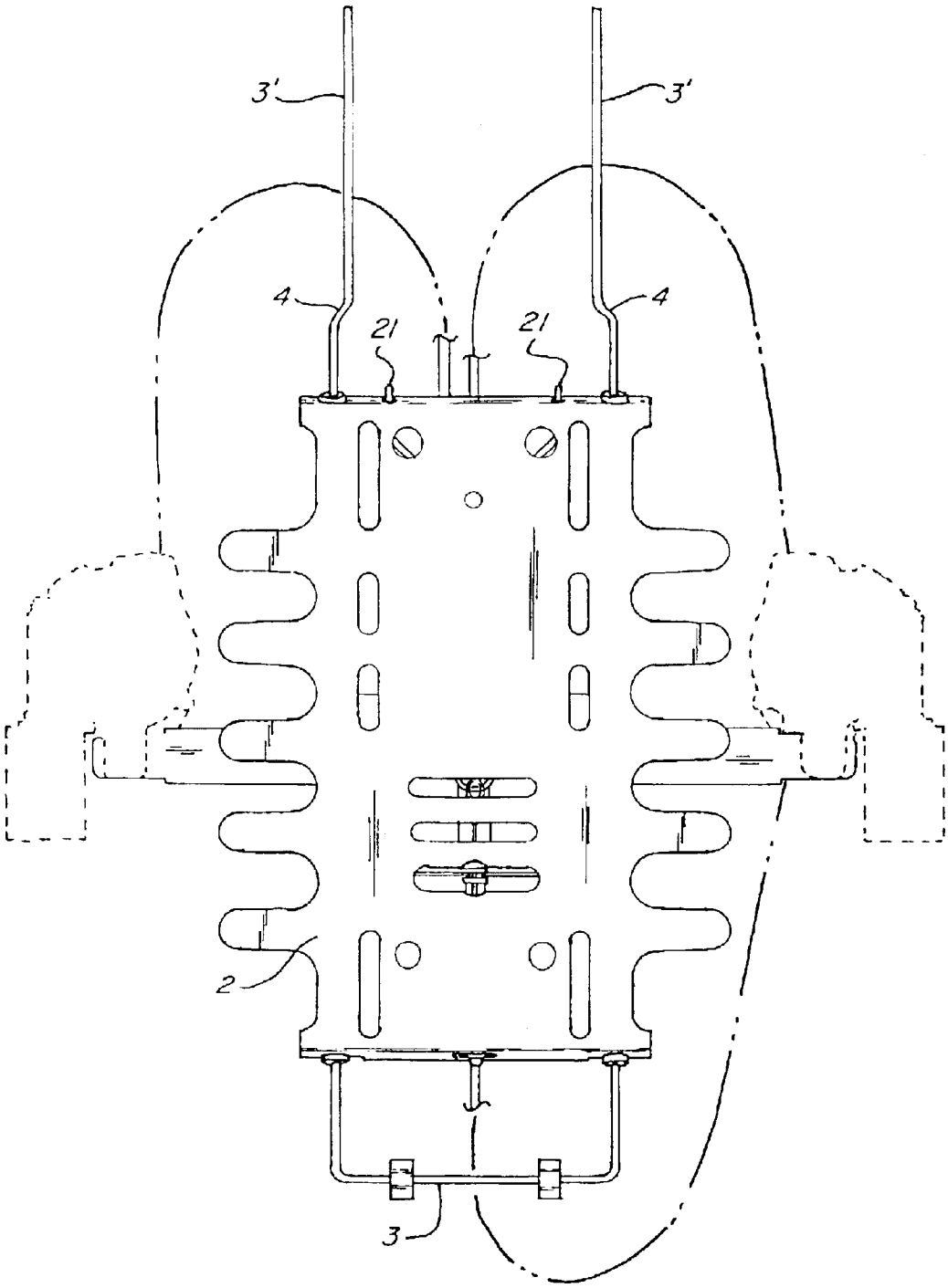
FIG. 2 illustrates a rear view of the lumbar support system of the present invention.
Figure 4:
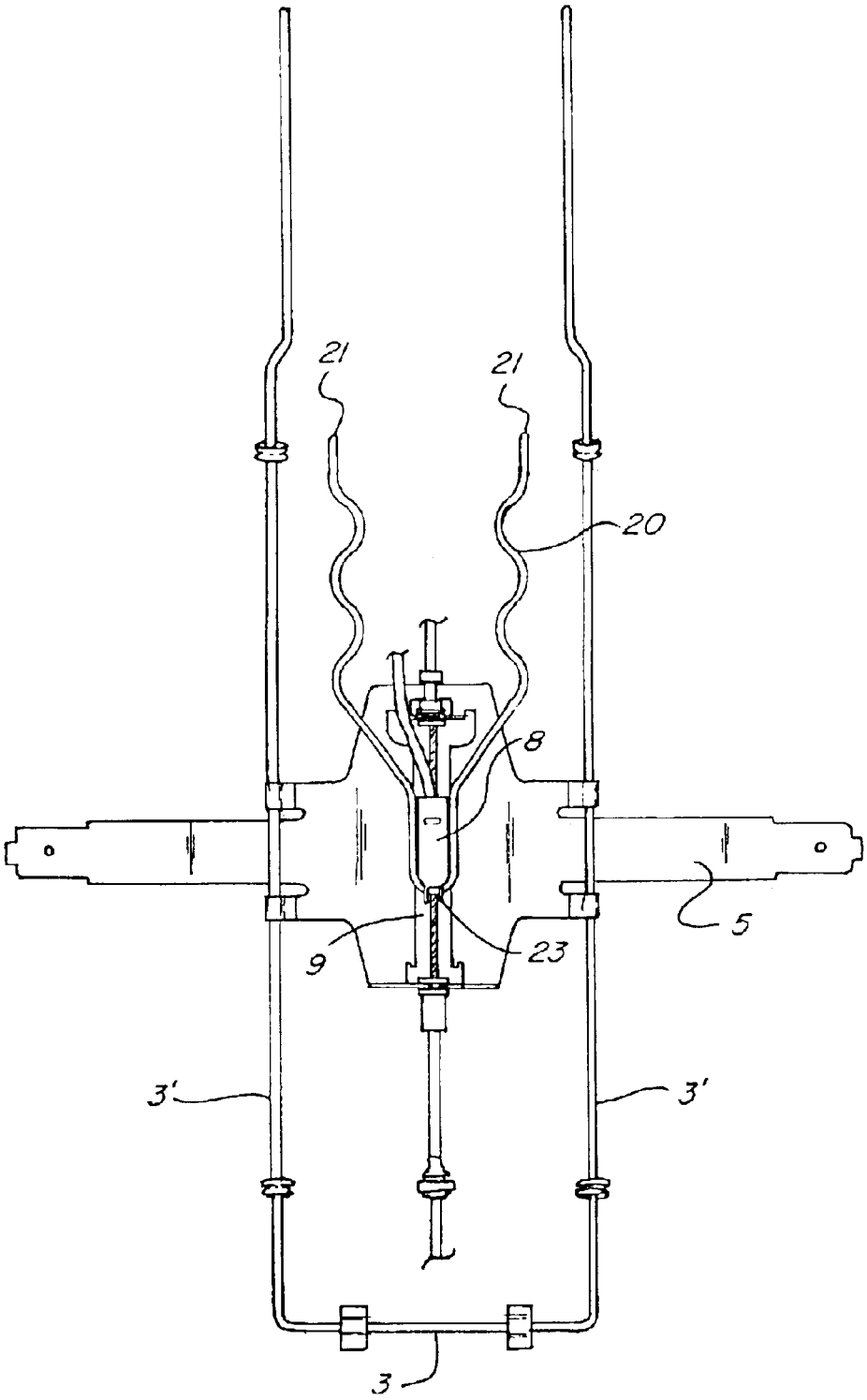
FIG. 4 illustrates a rear view of the lumbar support system of the present invention, without the basket attached.

A yoke wire 20 has two engaging hooks 21, 21, shown in FIGS. 1, 2 and 3, at one of its ends that engage two holes 22, 22 at the top end of the support element 2. As shown in FIGS. 4 and 5, the slide 8 includes a third engaging hook 23, which engages the yoke wire 20. Yoke 20 serves to rigidly attach slider 8 with support surface 2. Alternative attachments may be used. Accordingly, when slider 8 moves in either a first or second direction, the support element 2 will also move in the same first or second direction. Since the engagement of the first Bowden cable 10 which achieves the arching of the flexible support surface 2, is through the slider 8, the user selected degree of curvature of the flexible support element 2 will be preserved as the second Bowden cable(s) 15 moves the support element 2 upwards and downwards. Alternatively, a fixed (non-flexing) support may be used.

The device shown in FIG. 1 operates in the following manner. The support element 2 is shown in a substantially flat, undeflected shape. As the first actuator 13 is activated to retract the first wire 11, the distance between the top and bottom ends of the support element 2 decreases, resulting in the bowing of the support element 2 in an outward direction and thus providing additional lumbar support. The first actuator 13 may be activated by the occupant of a seat by use of a variety of equivalent activating means that are known in the art. Those skilled in the art will appreciate that that a variety of equivalent activating means may be used with the present invention without departing from the scope of the claims herein.

When the desired amount of lumbar support is achieved, the seat occupant may discontinue activation of the first actuator 13. The tension between the first cable mount fixation to slider 8 and the first wire 11 mount 14 on support surface 2, will maintain the degree of curvature selected by the user after the user disengages that actuator. Likewise, the first actuator 13 may be reversed to extend the first wire 11, thus increasing the distance between the top and bottom ends of the support element 2. As a result, the flexible support element 2 begins to relax in an inward direction, thereby flattening the support element 2.

The system may also be operated to provide for adjustment of the support element 2 in a vertical direction. This is achieved by activating the second actuator 19 in a first direction, thereby resulting in the pulling of the second wire 16 in the first direction, for example, upwards. The linear movement of the second wire 16 is transferred to the slider 8 and causes the slider 8 to slide in an upward direction, along the slider guide 9 of the mounting bracket 5. The slider 8, in turn, transfers the force of the movement of the second wire 16 to the support element 2 through the fixed yoke wire 20. This transferred force causes the support element 2 to move in an upward direction along the guide wire members 3', 3'.

Because the slider 8 and flexible pressure surface 2 move in unison, the selected degree of arching of the support element 2 will be maintained during vertical movement of it by tension of actuator 19 through 16. Adjustment of the support element 2 in a downward direction is likewise achieved by activating the second actuator 19 in a second direction to cause a second, opposing tractive force pulling the second wire 16 in a downward direction, again moving support element 2 through the linkage of Yoke 20.

Figure 7:
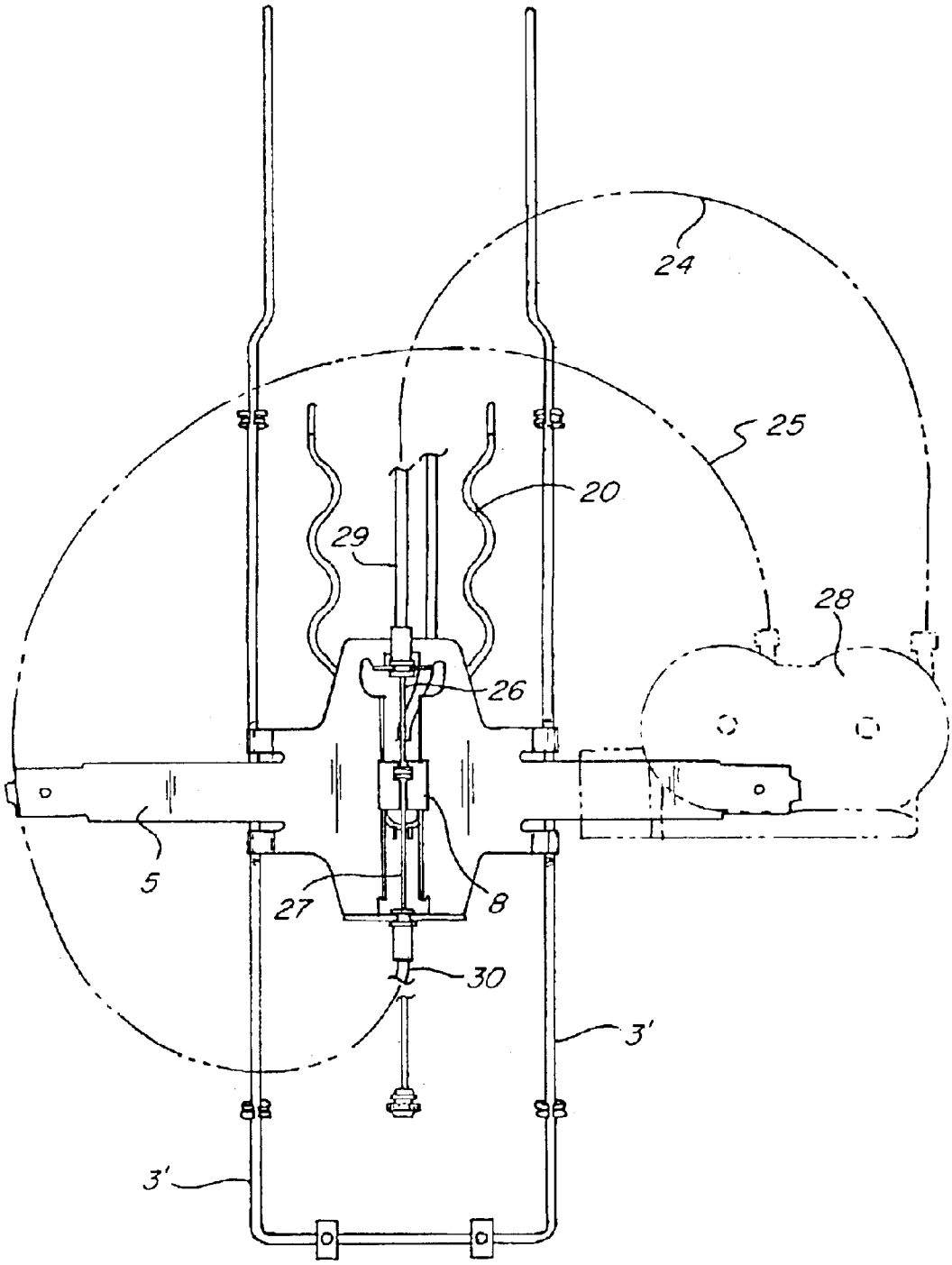
FIG. 7 illustrates front view of an embodiment of the present invention without the basket attached, having a two-cable assembly for height adjustment of the flexible support element.

In another preferred embodiment shown in FIG. 7, the cable assembly for the adjustment of the support element 2 in the vertical direction includes two separate traction cables—an upper traction cable 24 and a lower traction cable 25, shown in broken lines. This embodiment is similar to the other embodiment described herein, except that this embodiment employs two separate traction cables 24, 25 for level adjustment in a vertical direction. The upper traction cable 24 has one end operably coupled to an actuator 28 having a two-cable output and an opposite end operably coupled to the slider 8. The upper traction cable 24 is comprised of an upper traction cable wire 26 in an upper sleeve 29. The lower traction cable 25, likewise, has one end operably coupled to the two-cable output actuator 28 and an opposite end operably coupled to the slider 8 and is comprised of a lower traction cable wire 27 in a lower sleeve 30. Adjustment in a vertical direction is achieved by activation of the actuator 28, which pulls either the upper traction cable wire 26 or the lower traction cable wire 27 to cause upward or, alternatively, downward travel. The linear movement of the upper traction cable wire 26 and the lower traction cable wire 27 is transferred to the slider and 8 causes the slider 8 to slide in either an upward or downward direction, along the slider guide 9 of the mounting bracket 5. The slider 8, in turn, transfers the force of the movement of the wires 26, 27 to the support element 2 through the fixed yoke wire 20. This transferred force causes the support element 2 to move in an upward or downward direction along the guide wire members 3', 3'.

Figure 6:
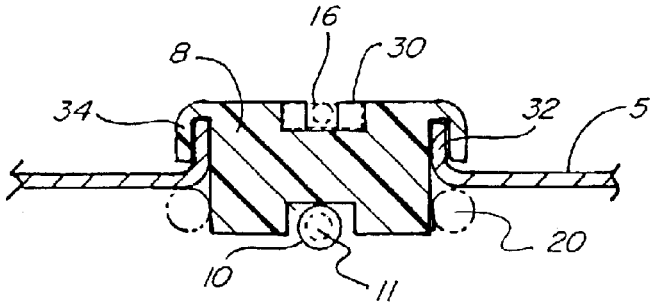
FIG. 6 illustrates a cross-sectional bottom view of the slider of the present invention.

FIGS. 5 and 6 are a close up and a cross section, respectively, illustrating a closer view of the slider 8 and its connections with the other elements of the present invention. Vertical traction wire 16 is mounted to a upper portion of slider 8 at mounts 30. Any of a variety of mounts known in the art may be used. Typically, bullets on the ends of wire 16 would be seated in a recess molded or cut into the top of slider 8. In the depicted embodiment the slider guide slot has been fabricated by cutting guide slot 9 from mounting bracket 5, also producing the upturn edges of metal bracket 5 from where slot 9 has been cut. The upturn flanges 32 of mounting bracket 5 which define the edges of slot 9 slidingly engage slider 8 by means of their complementary cooperation with slider extensions 34. Yoke 20 is fixed to the lower portion of slider 8 at yoke mount 23. Underneath slider 8 and obscured by it in the perspective view of FIG. 5, is a sleeve support for first sleeve 10. The end of first sleeve 10 is thereby attached to slider 8 so that arching tension may be applied to the support element. From the end of first cable sleeve 10 proceeds first cable wire 11 which proceeds to mount to support element 2 at hook 14 as shown previously in FIG. 1.

Other objects, features and advantages will be apparent to those skilled in the art. While preferred embodiments of the present invention have been illustrated and described, this has been by way of illustration and the invention should not be limited except as required by the scope of the appended claims.

What is claimed is:

1. An adjustable lumbar support device comprising:

at least one guide wire;

a fixed mounting bracket having a first sleeve support, a second sleeve support and a slider guide;

a slider engaged with said slider guide, said slider being attached to a support element such that movement of said slider moves said support element, wherein said support element is slidably engaged with said guide wire; and a first traction cable and a second traction cable, each being engaged with an actuator and each having a wire disposed to slide axially through a sleeve, said first traction cable having a first wire end attached to said slider and said first traction cable having a first sleeve end attached to said first sleeve support and said second traction cable having a second wire end attached to said slider, and said second traction cable having a second sleeve end attached to said second sleeve support;

whereby traction on said first traction cable draws said slider and said support element in a first direction and traction on said second traction cable draws said slider and said support element in a second direction.

2. The adjustable lumbar support device of claim 1 wherein said first wire end and said second wire end are ends of the same wire.

3. A lumbar support device according to claim 1, wherein said traction cable is a bowden cable.

4. A lumbar support device according to claim 1, wherein said slider guide is a slot.

5. A lumbar support device according to claim 1, wherein said at least one guide wire is comprised of a pair of guide rods.

6. A lumbar support device according to claim 1, wherein said first traction cable and said second traction cable are each engaged with separate actuators.

7. A lumbar support device according to claim 1, wherein said first direction and said second direction are substantially vertical, and substantially opposing.

8. A lumbar support device according to claim 1, further comprising a yoke wire having a first yoke end connected to said support element and a second yoke end connected to said slider, wherein upon displacement of said traction cable and said slider, force is transferred to said support element through said yoke, causing adjustment of the position of said support element.

9. An adjustable lumbar support device comprising:

a guide rod adaptable to mount on a seat frame;

a flexible support element mounted to slide on said guide rod;

a fixed mounting bracket mounted on said guide rod, said fixed mounting bracket having a first sleeve support, a second sleeve support, and a slider guide;

a slider engaged with said slider guide, said slider having a third sleeve support and said slider being attached to said flexible support element such that movement of said slider moves said flexible support element;

a first traction cable and a second traction cable, each being engaged with an actuator and each having a wire disposed to slide axially through a sleeve, said first traction cable having a first wire end attached to said slider and said first traction cable having a first sleeve end attached to said first sleeve support and said second traction cable having a second wire end attached to said slider, and said second traction cable having a second sleeve end attached to said second sleeve support;

whereby traction on said first traction cable draws said slider and said flexible support element in a first direction and traction on said second traction cable draws said slider and said flexible support element in a second direction; and a third traction cable engaged with a second actuator and having a third wire end disposed to slide axially from a third sleeve end, said third sleeve end being attached to said third sleeve support on said slider and said third wire end being attached to said flexible support element;

whereby traction on said third traction cable flexes said flexible support element into a selectable degree of lumbar supporting arch, said selectable degree of lumbar supporting arch being maintained upon movement of said flexible support element in said first direction and in said second direction.

10. An adjustable lumbar support device comprising:

a pair of guide rods;

a mounting bracket having a fixed position relative to said guide rods, said mounting bracket further comprising a first sleeve support, a second sleeve support and a slider guide;

a support element slidably engaged with said pair of guide rods;

a pair of traction cables, wherein each of said traction cables comprises a wire disposed to slide axially through a sleeve, said wire being connected to at least one of said mounting bracket and said support element and said sleeve being connected to the other of said mounting bracket and said support element;

at least one actuator operatively with said pair of traction cables whereby traction on one of said pair of traction cables draws said support element in a first direction and traction on said other of said pair of traction cables draws said support element in a second direction;

a slider engaged with said slider guide, said slider being attached to said support element such that movement of said slider moves said support element; and a yoke wire having a first yoke end connected to said support element and a second yoke end connected to said slider, wherein upon displacement of said traction cable and said slider, force is transferred to said support element through said yoke, causing adjustment of the position of said support element.

* * * * *